US006951437B2

(12) United States Patent
Hall

(10) Patent No.: US 6,951,437 B2
(45) Date of Patent: Oct. 4, 2005

(54) FOUNDATION SUPPORT SYSTEM AND METHOD

(76) Inventor: David B. Hall, 847 Middle Run Ct., Duncanville, TX (US) 75137

( * ) Notice: Subject to any disclaimer, the term of this patent is extended or adjusted under 35 U.S.C. 154(b) by 0 days.

(21) Appl. No.: 10/783,074

(22) Filed: Feb. 20, 2004

(65) Prior Publication Data

US 2005/0186034 A1 Aug. 25, 2005

(51) Int. Cl.[7] ..... E02B 5/00; E02B 7/22
(52) U.S. Cl. ..... 405/253; 405/252; 405/230
(58) Field of Search ..... 405/253, 254, 405/252.1, 252, 251, 250, 249, 232, 231, 405/230, 227

(56) References Cited

U.S. PATENT DOCUMENTS

| | | | | |
|---|---|---|---|---|
| 825,599 | A * | 7/1906 | Healy | 405/250 |
| 1,954,070 | A * | 4/1934 | Cook | 405/254 |
| 2,562,860 | A | 7/1951 | Cobi | |
| 3,194,022 | A | 7/1965 | Dougherty | |
| 3,194,328 | A * | 7/1965 | Fiore | 405/253 |
| 3,199,300 | A * | 8/1965 | Fiore | 405/251 |
| 3,306,054 | A | 2/1967 | Dougherty | |
| 3,333,428 | A | 8/1967 | Dougherty | |
| 3,333,430 | A | 8/1967 | Dougherty | |
| 3,899,891 | A * | 8/1975 | Kelly et al. | 405/251 |
| 4,657,441 | A | 4/1987 | Horvath | |
| 5,188,485 | A | 2/1993 | Forster et al. | |
| 5,288,175 | A | 2/1994 | Knight | |
| 5,295,767 | A | 3/1994 | Taki | |
| 5,505,561 | A | 4/1996 | Willcox, III | |
| 6,609,856 | B1 | 8/2003 | Knight | |

FOREIGN PATENT DOCUMENTS

| | | |
|---|---|---|
| EP | 65340 | * 11/1982 |

* cited by examiner

*Primary Examiner*—Frederick L. Lagman
(74) *Attorney, Agent, or Firm*—Gardere Wynne Sewell LLP

(57) ABSTRACT

A building foundation support and repair system includes a column of generally cylindrical pile sections driven into the earth below the edge of the foundation and having an earth penetrating bit attached to the lowermost pile section. The bit includes a center post member extending within a bore in the lowermost pile section and/or a sidewall journaling the lower end of the lowermost pile section. The bit may be connected to an elongated rod extending through the series connected pile sections and used to drive the bit rotatably during installation of the pile sections and to minimize lateral excursion of the support system during and after installation of the column of pile sections.

10 Claims, 3 Drawing Sheets

FOUNDATION SUPPORT SYSTEM AND METHOD

BACKGROUND OF THE INVENTION

Building foundation support and repair systems have been developed which comprise columns of generally cylindrical concrete pile sections which are placed under the edge of an existing foundation and driven into the ground below the foundation until the lowermost pile section encounters a load bearing strata or otherwise is driven to refusal. This process is carried out by excavation adjacent to the existing foundation, placement of a pile section under the foundation and, typically, placing a hydraulic ram mechanism between the foundation and the pile section for driving the pile section into the earth. Additional pile sections are added to the column until the column meets refusal.

Several problems are encountered with conventional foundation repair and support systems of the type described above. The cylindrical pile sections may encounter tree roots, stones or other obstructions as they are being driven downward into the earth and will tend to skew away from the vertical upon encountering such obstructions, resulting in an inferior and unsuitable support system. Improvements have been sought with regard to multi-section pile type foundation support systems wherein the cylindrical pile sections have a central bore extending longitudinally therethrough and a cable is extended through the bores of the pile sections in an effort to minimize the tendency for the pile sections to undergo lateral excursion during and after completion of the support system installation. Flexible cable supported columns of pile sections tend not to be as stable as desired.

Previous efforts have also been carried out to minimize the tendency for the pile sections to undergo lateral excursion during installation upon, for example, encountering one or more of the above-mentioned anomalies. However, such previous efforts have been deemed inadequate when attempting to install a substantially vertical, stable column of concrete pile sections for foundation support systems.

It is to overcome the deficiencies in prior art foundation support and repair systems that the present has been developed.

SUMMARY OF THE INVENTION

The present invention provides an improved foundation support and/or foundation repair system. The present invention also provides an improved method of installing a foundation support system of the type comprising, plural, generally cylindrical pile sections which are driven into the earth below an existing foundation or in preparation for supporting a foundation for a building or other structure.

In accordance with one important aspect of the present invention, a foundation support system and method is provided wherein the lowermost cylindrical pile section of a foundation support pile is provided with a "bit" which is operably connected to the lowermost pile section in such a way as to eliminate lateral excursion of the bit and the pile section when driven into the ground. In particular, the bit may comprise a generally cylindrical steel plate having on its lower face plural teeth which provide cutting action as the bit is driven into the ground and provide for rotation of the bit for a more true vertical penetration of the bit and the pile sections. Lateral excursion of the bit is eliminated by a center post member which extends within a cylindrical bore in the associated pile section. One embodiment of the bit includes a cylindrical outer wall to provide a somewhat cup-shaped member which receives the lower end of a pile section. The bit is proportioned such that it may freely rotate with respect to the pile section as the driving or penetrating action is carried out. A bit, in accordance with the invention, may also include a generally flat plate supporting the center post member and a single conical shaped earth penetrating tooth.

In accordance with another aspect of the invention, an improved method of installing a pile type support system for a building foundation is provided wherein a bit of one of the types described above is provided mounted on the lower face of the lowermost pile section with a center post extending within a bore in the pile section or configured to journal the lower end of the pile section. At least the lowermost pile section may be provided with a metal tubular sleeve disposed within the aforementioned bore to receive the center post member of the bit in such a way that stress on the pile section is withstood by the metal sleeve and distributed over the pile section to minimize crushing or breakage of concrete pile sections, in particular.

Still further, the present invention provides a foundation support system and method wherein a bit of one of the types described above is connected to the lower face of a lowermost pile section and the pile sections are driven into the ground one after another and wherein an elongated steel rod is extended through the bores of the pile sections. The rod is connected to the bit and during installation of the pile sections, the rod may be rotatably driven to rotate the bit to facilitate the driving action into the earth whereby a cylindrical pile type support column is provided which extends in a more true vertical direction until bedrock or a load bearing strata in the earth is encountered by the bit.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENTS

Figure 1:
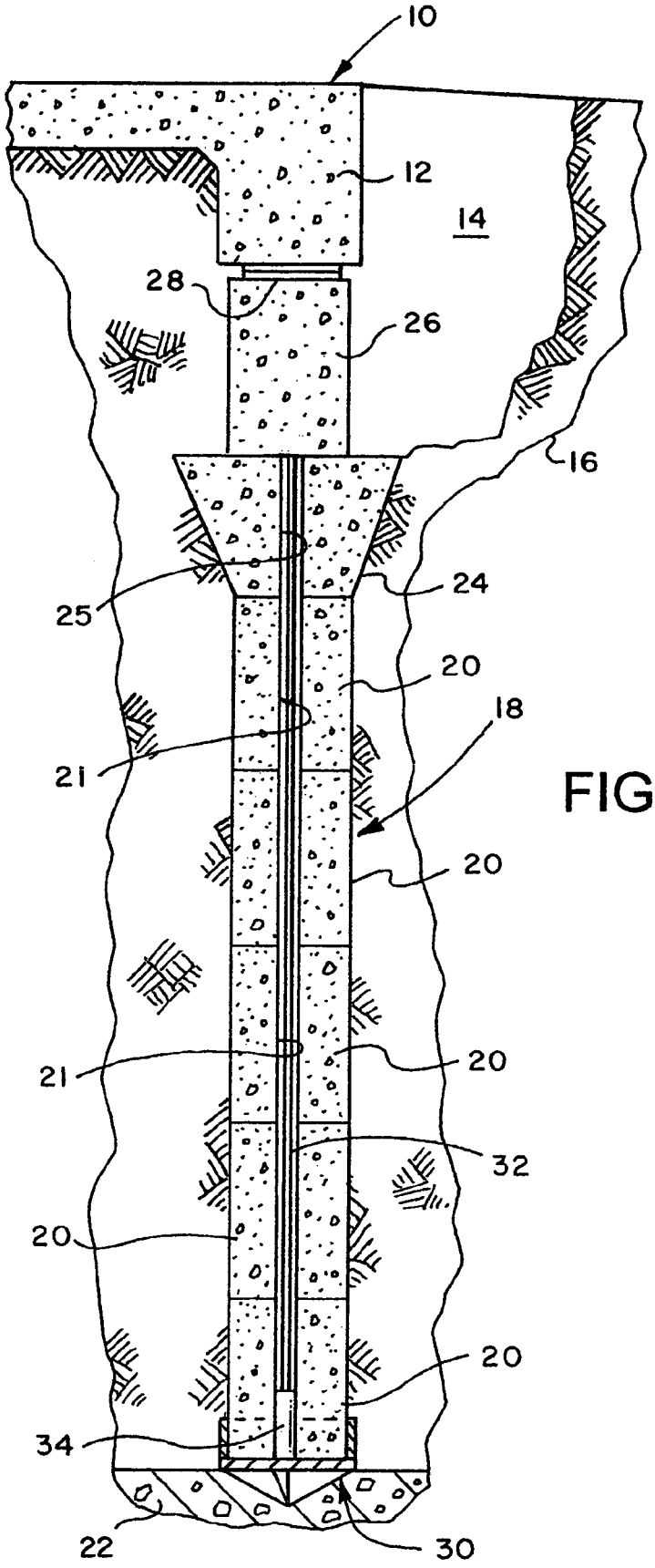
FIG. 1 is a vertical section view, in somewhat schematic form, showing a completed foundation support system in accordance with the present invention.

In the description which follows, like parts are marked throughout the specification and drawing with the same reference numerals, respectively. The drawing figures may not be to scale and certain elements may be shown in somewhat generalized or schematic form in the interest of clarity and conciseness.

Referring to FIG. 1, there is illustrated a portion of a building foundation, generally designated by the numeral 10 of a conventional type, such as a conventional so-called slab type foundation for a residential dwelling. A perimeter edge 12 of foundation 10 is shown exposed by an excavation 14 in the earth 16 so that a foundation support system 18 in accordance with the invention may be installed and completed as illustrated in FIG. 1. Foundation support system 18 is characterized by a plurality of vertically stacked, preferably cylindrical, concrete pile sections 20 which are stacked in column fashion and have been driven into the earth in a manner to be described herein until the column of pile sections encounters bedrock or a load bearing strata 22. The finished foundation support system 18 is typically provided with a cap block 24 having a somewhat trapezoidal shape and operable to support two spaced apart column sections 26, one shown, of a conventional type which are interposed the block 24 and the foundation edge 12. Final positioning of the supported or repaired foundation 10 may also require conventional metal leveling shims 28, as illustrated.

What has been described immediately herebefore is a conventional foundation support and repair system for situations where a foundation, generally of the type shown and described, may be provided with improved support, or repaired to prevent sinking, by a column of generally cylindrical concrete pile sections driven into the earth one after another until refusal. Typically, the pile sections 20 are of from about 3.0 to 6.0 inches in diameter and 10.0 to 12.0 inches in length. The pile sections 20 are typically formed of cast concrete and are also typically provided with a central longitudinal bore 21, see FIG. 2 also. The bore 21 may typically be 0.75 to 1.0 inches in diameter and the pile sections may have a compressive strength in excess of 5,000 pounds per square inch (psi).

Figure 2:
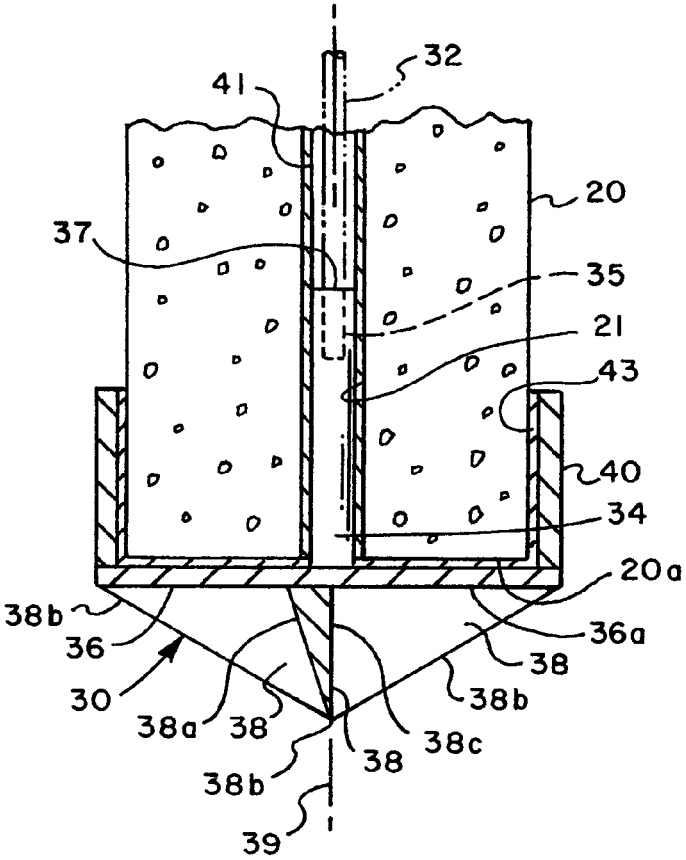
FIG. 2 is a central section view of one preferred embodiment of a foundation support system bit in accordance with the invention operably connected to a concrete pile section of the type shown in FIG. 1.
Figure 3:
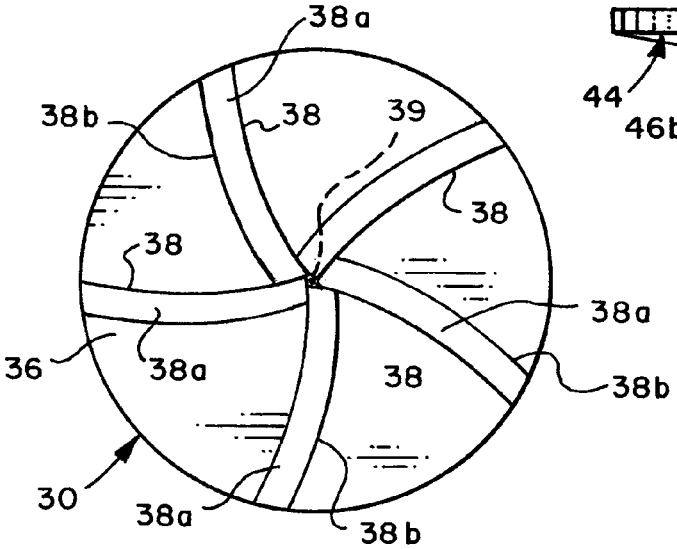
FIG. 3 is a bottom plan view of the bit shown in FIG. 2.

FIG. 1 illustrates a completed foundation support system in accordance with the invention wherein the lowermost pile section 20 in the column has mounted thereon a unique earth penetrating bit, generally designated by the numeral 30 in FIGS. 1, 2 and 3. The bit 30 is installed on the lowermost pile section 20 prior to commencing driving that pile section into the earth using a hydraulic ram placed under the edge 12 of the foundation and as will be described further herein. In FIG. 1 there is also illustrated an elongated steel rod support member 32 which extends from the bit 30 upwardly through the central bores in the pile sections 20 and also through a central bore 25 provided in the cap block 24. The elongated rod 32 is drivably connected to a central, axially extending, post member 34 formed as an integral part of the bit 30, see FIGS. 1 and 2.

Referring now to FIGS. 2 and 3, the bit 30 is characterized by a generally cylindrical planar, bottom plate part 36 which may be formed of steel or other conventional high-strength metals, having a diameter of approximately 3.0 inches to 6.50 inches and a thickness of from about 0.125 inches to 1.0 inches. The bit bottom plate 36 is preferably provided with downwardly projecting, circumferentially spaced and radially extending tapered bit teeth 38 which are provided five in number for the bit 30 although different numbers of teeth 38 may be provided. The bit 30 has a central longitudinal axis 39 and the upwardly extending post member 34 is coaxial with the axis 39. The bit 30 is also provided with a cylindrical sidewall 40 extending upward from the bottom plate 36 and formed integral with or suitably secured thereto, such as by welding. The center post member 34 has a longitudinal central bore 35 formed therein and opening to the upper end face 37 of the center post member. The bore 35 may be provided with internal threads or a bayonet type j-slot configuration for receiving the lower distal end of the rod 32. Accordingly, the lower end of rod 32 may be configured to be placed in driving engagement with the post 34 for rotating the bit 30, as needed.

The bit teeth 38, as illustrated in FIGS. 2 and 3, have a curvature and inclined faces 38*a*, respectively. The faces 38*a* are inclined with respect to the axis 39. In this way, as the pile sections 20 are being driven into the earth, the bit 38 will tend to rotate to aid in cutting through the earth and penetrating any anomalies that may be encountered, including tree roots, compacted earth, stones or other anomalies. In this regard, the bit teeth 38 also each have a downward facing cutting edge 38*b*. The backside of each bit 38, generally designated by numeral 38*c*, is disposed substantially in a plane parallel to the axis 39. The bit teeth 38 may be formed such that the cutting edges 38*b* are disposed from 0.25 inches to 4.0 inches from the bottom face 36*a* of plate 36. Typically, the teeth 38 will have cutting edges 38*b* which are inclined to axis 39 and extend from a central or radially innermost edge of each tooth radially outwardly to the perimeter of the plate 36, as illustrated in FIGS. 2 and 3.

Further preferred dimensions for the bit 30 include a center post 34 diameter of from 0.63 to 0.75 inches and an overall length of about 0.25 to 20.0 inches. Typically, the height of the sidewall 40 will be about one-half the height or length of the center post or shaft member 34. As shown in FIG. 2, one important aspect of the invention is the provision of a tubular metal sleeve 41 disposed in the bore 21 of each pile section 20, respectively, or at least the lowermost section connected to the bit 30. The tubular sleeve 41 may be a slip-fit or a light press fit within the bores 21 and dimensioned to receive the center post or shaft member 34 of the bit 30 in sliding engagement therewith. By providing the sleeve 41 stresses encountered by forces exerted by the bit 30 on a pile section 20 are distributed more evenly thereby minimizing the chance of the pile section 20 breaking during the driving process. Typically, also, the inside diameter of the sidewall 40 of the bit 30 is slightly greater than the diameter of the pile section 20 whereby, upon installation of a bit 30 on a pile section, such as shown in FIG. 2, a layer of lubricant 43, FIG. 2, such as machine grease, may be interposed the sidewall and bottom face of the pile section 20 and the bit 30 to facilitate rotation of the bit with respect to the pile section.

Figure 4:
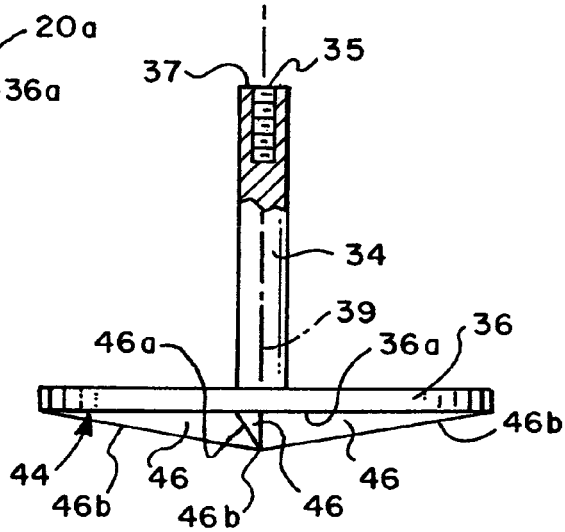
FIG. 4 is a side elevation of an alternate embodiment of a pile driving bit for a foundation support system in accordance with the invention.

Referring now to FIG. 4, another embodiment of a bit for the foundation support system in accordance with the invention is illustrated and generally designated by the numeral 44. The bit 44 is similar in some respects to the bit 30 and comprises a generally flat cylindrical plate member 36 a center post 34 with an internally threaded upward facing bore 35 opening to end face 37 and an array of cutting teeth 46 similar to the teeth 38 but of substantially lesser depth, as illustrated. The teeth 46 are typically, otherwise, generally like the teeth 38 and include inclined faces 46*a* and cutting edges 46*b*. Teeth 38 and 46 may be formed integral with the bottom plate 36 or may be welded thereto. The teeth 38 and 46 may be formed of hardened steel as with the plate 36. The bits 30 and 44 may be fabricated using conventional manufacturing practices and are typically fabricated of high strength steel wherein the components such as the plate 36, sidewall 40, center post 34 and teeth 30 or 46 are separately fabricated and welded to form the respective bit assemblies of the bits 30 and 44. Other manufacturing practices may be carried out.

Figure 7:
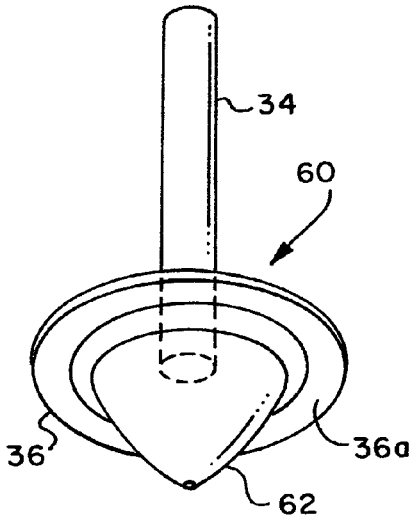
FIG. 7 is a perspective view of another embodiment of an earth penetrating bit in accordance with the invention.

Referring briefly to FIG. 7, another embodiment of an earth penetrating bit for the foundation support system of the present invention is illustrated and generally designated by the numeral 60. The bit 60 may utilize the bottom plate member 36 and center post member 34 and/or a sidewall similar to the wall 40, but not shown in FIG. 7. The bit 60 differs from the bits 30 and 44 in that a single downwardly projecting axial and conical shaped projection 62 is formed on or secured to the bottom face 36*a* of the bottom plate 36. The conical projection or tooth 62 is preferably coaxial with the axis 39. The bit 60, when connected to a lowermost pile section 20, facilitates penetration of the earth during the pile section driving process and yet exposes a sufficient amount of the bottom face 36*a* of the plate 36 to avoid further penetration of the foundation support system once it has been installed. In this regard, the diameter of the projection 62, at its point of connection to the plate 36, would be about 4.6 inches for a plate diameter of 6.0 inches. Still further, the conical sidewall of the projection 62 may have a slightly convex shape having a radius of curvature of about 7.8 inches. The overall height or depth of the conical projection 62 may be in the range of 1.0 to 4.0 inches.

Figure 5:
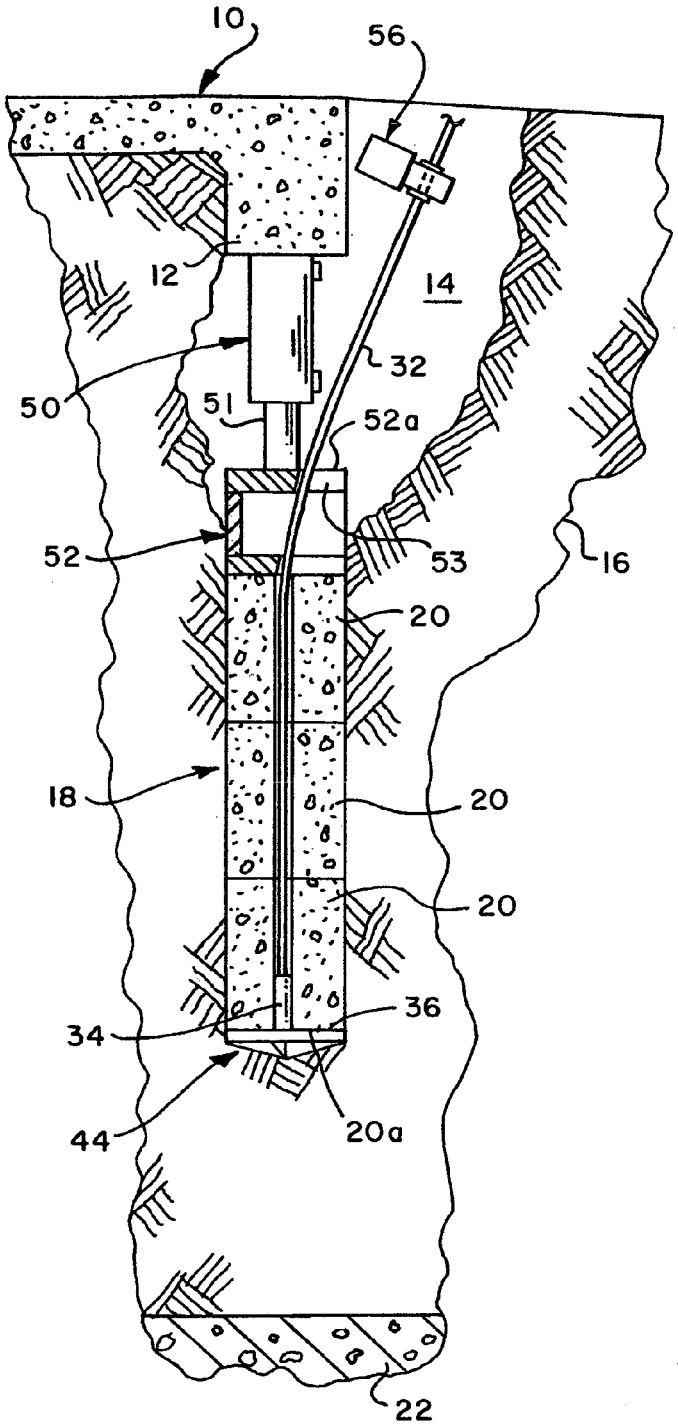
FIG. 5 is a vertical section view, in somewhat schematic form, showing the foundation support system of the present invention during installation thereof.

Referring now to FIG. 5, a method of installing the improved foundation support system of the present invention is illustrated in process. After formation of the excavation 14 a lowermost pile section 20 is placed in the excavation below a hydraulic ram or jack 50 which has been placed in a working position below the foundation edge 12, as illustrated. The ram or jack 50 may be a hydraulic cylinder and piston device particularly configured for use in driving concrete pile sections, such as the sections 20 illustrated in FIG. 5. Prior to placement of the lowermost pile section 20 in the excavation 14 a bit, such as the bit 44 may be installed on the bottom face 20*a* of the lowermost pile section and driven downward by the hydraulic jack or ram 50 until the maximum stroke of the jack is encountered. The hydraulic ram or jack piston rod 51 is then retracted in a conventional manner and the next pile section 20 is installed above the first mentioned pile section.

Figure 6:
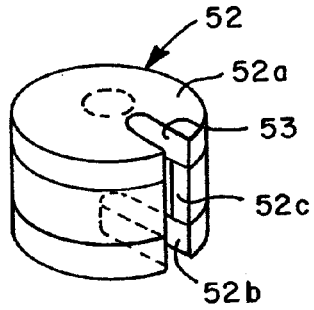
FIG. 6 is a perspective view of a collar member adapted to be interposed a drive member and a column of pile sections in accordance with the system and method of the invention as shown in FIG. 5.

During driving of the first or lowermost pile section 20 with the bit 44 attached thereto, an elongated rod 32 may be extended through the bore 21 in the pile section 20 and drivingly connected to the center post 34 of bit 44. If the rod 32 is installed during the driving phase of the installation of the foundation support system, an intermediate plate or collar 52 may be installed and engaged with the column of pile sections and with the piston rod 51 as illustrated in FIG. 5. The collar 52 is preferably formed with upper and lower plate members 52*a* and 52*b*, see FIG. 6 also, and an intermediate sidewall part 52*c*. An elongated radially projecting slot 53 is formed in the collar 52 and opening to the outer surface thereof, see FIG. 6, for receiving the rod 32. Accordingly, during installation of a foundation support system in accordance with the invention the bit 44 or, alternatively, the bit 30 may be rotatably driven independent of the axial column forcing action of the ram 50 by rotating the rod 32 by a suitable power tool 56, FIG. 5. Manual rotation of the rod 32 may be carried out to rotate the bit 44 to aid in the cutting action of the bit as the column of pile sections 20 is driven toward a load bearing strata or bedrock 22. The collar 52 is exemplary and other forms of load transfer devices may be interposed the column of pile sections 20 and a hydraulic jack or ram, such as the ram 50, during the support system installation procedure.

Accordingly, as pile sections 20 are added during the driving process, until bedrock or a load bearing strata is encountered, collar 52 may be interposed the ram 50 and each successive pile section 20 added to the column after retracting the piston rod 51 to allow the addition of each successive pile section to the column. Providing the collar 52 allows use of the rod 32 to rotate the bit, if needed. In all events, the collar 52 is preferably used during the pile section installation process since the installation of the rod 32 is desired whether it is used to drive the bit or not because the rod 32 is also used to minimize any tendency for the pile sections 20 to undergo lateral excursion once the column of pile sections has been completed.

Once the column of pile sections 20 has been driven to refusal and the final pile section or cap block, such as the block 24, is installed, the rod 32 may be cut to the requisite length extending through a bore 25, FIG. 1, in the uppermost pile section or cap block 24, as illustrated. As pile sections 20 and block 24 are added, they may be sleeved over the rod 32. The rod 32 may remain connected to post 34 during the pile column installation process or disconnected from and reconnected to post 34 each time a pile section is added. The rod 32 is preferably of high strength steel and having a diameter of about 0.25 to 0.50 inches.

Accordingly, an improved foundation support and/or repair system in accordance with the invention is provided wherein a rotatable bit having a center shaft or post member and/or a somewhat cup-shaped configuration is provided for remaining firmly secured to a pile section, the bit including an improved configuration of cutting teeth and a substantially flat transversely extending plate member forming part of the bit which minimizes the chance of further penetration of the column of pile sections once the support system has been completed. Still further, the foundation support system of the present invention provides an improved method of installing a column of pile sections of the type described herein and a central, somewhat flexible but also stiff continuous rod member is provided which exhibits improved performance with respect to minimizing lateral excursions of the pile column members or pile sections 20 of a foundation support system, such as the system 18.

Although an improved foundation support system and method in accordance with the invention have been described in detail herein, those skilled in the art will also recognize that various substitutions and modifications may be provided without departing from the scope and spirit of the appended claims.

What is claimed is:

1. A foundation support system comprising plural generally cylindrical pile sections stacked one above another, said support system including:

an earth penetrating bit attached to a lowermost pile section including a transverse, generally cylindrical bottom plate member and earth penetrating means formed on a downward facing side of said bottom plate member, said bit including a part engageable with said lowermost pile section to prevent lateral excursion of said bit with respect to said pile sections during driving of said pile sections into the earth; and a single solid elongated rod member extending within a central bore of respective ones of said pile sections and connected to a part of said bit to minimize lateral excursion of said bit and said pile sections with respect to each other.

2. The support system set forth in claim 1 wherein:

said bit includes a generally central upwardly extending post member secured to said bottom plate member and adapted to be disposed in said central bore formed in said lowermost pile section.

3. The support system set forth in claim 1 wherein:

said bit includes a generally cylindrical outer sidewall secured to said bottom plate member and dimensioned to receive a lower end of said lowermost pile section therewithin.

4. The support system set forth in claim 3 wherein:

said sidewall is dimensioned to receive said lowermost pile section rotatably within a recess formed between said sidewall and said bottom plate member, and a layer of lubricant is provided between said bit and said lowermost pile section to facilitate rotation of said bit with respect to said lowermost pile section.

5. The support system set forth in claim 1 wherein:

said earth penetrating means comprises plural teeth including respective faces inclined with respect to a central axis of said bit to facilitate penetration and rotation of said bit during installation of said support system.

6. The support system set forth in claim 1 wherein:

said earth penetrating means comprises a downward extending conical projection on said bottom plate member.

7. The support system set forth in claim 1 wherein:

said bit includes a center post member extending within said bore of said lowermost pile section and adapted to be driveably connected to one end of said rod member.

8. A method for installing a foundation support system comprising a plurality of column stacked, generally cylindrical pile sections, comprising the steps of:

placing an earth penetrating bit connected to a lowermost one of said pile sections, said bit including a transverse bottom plate member having earth penetrating means thereon and a locating part for locating said bit with respect to said lowermost pile section to prevent lateral excursion of said bit with respect to said lowermost pile section;

driving said bit and said lowermost pile section into the earth while providing for rotation of said bit with respect to said lowermost pile section; and inserting an elongated rod through a bore in said lowermost pile section, said rod being extendable through plural ones of said pile sections upon installation thereof in said support system to minimize lateral excursion of said pile sections with respect to each other.

9. The method set forth in claim 8 including the step of:

connecting said rod to said bit and rotatably driving said rod and said bit during installation of said support system to facilitate penetration of said support system into the earth.

10. The method set forth in claim 9 including the step of:

placing a collar between one of said pile sections and a jacking device, said collar including a slot formed therein for receiving said rod whereby said rod may extend upwardly in driving connection with drive means for rotating said rod as successive ones of said pile sections are added to said support systems.

* * * * *